US011611183B2

(12) United States Patent
Jiang et al.

(10) Patent No.: US 11,611,183 B2
(45) Date of Patent: Mar. 21, 2023

(54) LAMP SOCKET, LAMP BASE, LIGHTING DEVICE AND LIGHTING SYSTEM

(71) Applicant: LEDVANCE GmbH, Garching bei Munich (DE)

(72) Inventors: Tianzheng Jiang, Shenzhen (CN); Bangzhou Liang, Shenzhen (CN)

(73) Assignee: LEDVANCE GMBH, Garching bei Munich (DE)

( * ) Notice: Subject to any disclaimer, the term of this patent is extended or adjusted under 35 U.S.C. 154(b) by 0 days.

(21) Appl. No.: 16/634,422

(22) PCT Filed: Jul. 27, 2017

(86) PCT No.: PCT/CN2017/094688
§ 371 (c)(1),
(2) Date: Jan. 27, 2020

(87) PCT Pub. No.: WO2019/019099
PCT Pub. Date: Jan. 31, 2019

(65) Prior Publication Data
US 2020/0161818 A1 May 21, 2020

(51) Int. Cl.

| | |
|---|---|
| ***H01R 33/09*** | (2006.01) |
| ***F21V 23/06*** | (2006.01) |
| ***H01R 13/04*** | (2006.01) |
| ***H01R 13/11*** | (2006.01) |

(52) U.S. Cl.
CPC ..... *H01R 33/09* (2013.01); *F21V 23/06* (2013.01); *H01R 13/04* (2013.01); *H01R 13/111* (2013.01)

(58) Field of Classification Search
CPC ..... H01R 33/09; H01R 33/06; H01R 13/64; H01R 13/111; H01R 13/04
See application file for complete search history.

(56) References Cited

U.S. PATENT DOCUMENTS

| | | | | |
|---|---|---|---|---|
| 5,261,833 | A * | 11/1993 | Pujol | H01R 13/4532 439/268 |
| 5,879,186 | A * | 3/1999 | Harada | H01R 33/09 439/549 |
| 6,033,249 | A * | 3/2000 | Holzer | H01J 5/56 439/356 |
| 6,113,416 | A * | 9/2000 | Holzer | H01R 33/06 439/357 |
| 7,293,897 | B2 | 11/2007 | Mendelsohn et al. | |
| 9,130,328 | B1 * | 9/2015 | Huang | H01R 13/2421 |
| 2010/0311267 | A1 * | 12/2010 | Mouchon | H01R 13/6272 439/375 |
| 2013/0273788 | A1 * | 10/2013 | Fujita | H01R 13/04 439/884 |

FOREIGN PATENT DOCUMENTS

| | | | |
|---|---|---|---|
| CN | 1805106 | A | 7/2006 |
| CN | 201078615 | Y | 6/2008 |
| CN | 106678565 | A | 5/2017 |

* cited by examiner

*Primary Examiner* — Eric T Eide
(74) *Attorney, Agent, or Firm* — Hayes Soloway PC

(57) ABSTRACT

A lamp socket for a lamp base, in particular a pin-based lamp base, is provided. The lamp socket comprises an electrically insulating housing having a cavity that is entirely framed by the housing in lateral directions, wherein the cavity is adapted for receiving a connector casing of the lamp base, wherein a bottom of the cavity comprises a receptacle for receiving a connector pin of the lamp base, and wherein a height of the cavity corresponds to at least a length of the connector pin.

19 Claims, 3 Drawing Sheets

LAMP SOCKET, LAMP BASE, LIGHTING DEVICE AND LIGHTING SYSTEM

CROSS-REFERENCE TO RELATED APPLICATIONS AND PRIORITY

This patent application claims priority from PCT Patent Application No. PCT/CN2017/094688 filed Jul. 27, 2017. This patent application is herein incorporated by reference in its entirety.

TECHNICAL FIELD

The present invention relates to a lamp socket, a lamp base, a lighting device and a lighting system.

TECHNICAL BACKGROUND

For connecting a lighting device to a voltage supply, usually a lamp base of the lighting device is inserted into a lamp socket. In the case of so-called pin-based lamp bases, the electrical connection is established via at least two connector pins that are plugged into corresponding receptacles of a light socket. Currently known lamp sockets for pin-based lamps are only adapted for operating voltages of 12 V. However, for some lighting applications, high operating voltages of at least 50 V, in particular 230 V, are required. Under these voltage conditions, currently known lamp sockets are a safety risk. In particular, the electrical clearance and/or the creepage distance of these common lamp sockets do not satisfy the safety requirements for higher operating voltages. For example, the lower safety precautions for 12 V lamp sockets may result in electrical shocks.

SUMMARY OF THE INVENTION

In view of the technical background, it is an object of the present invention to provide an improved lamp socket for a high operating voltage. A further object is to provide an improved lamp base for a lamp socket for a high operating voltage. Further objects are to provide a lighting device with an improved lamp base and a lighting system with an improved lamp socket and an improved lamp base.

These objects are solved by a lamp socket, a lamp base, a lighting device, and a lighting system according to the independent claims. Preferred embodiments are given by the dependent claims, the description and the drawings.

Accordingly, a lamp socket for a lamp base, in particular a pin-based lamp base, is provided. The lamp socket comprises an electrically insulating housing having a cavity, the cavity being entirely framed by the housing in lateral directions. The cavity is adapted for receiving a connector casing of the lamp base. A bottom of the cavity comprises a receptacle for receiving a connector pin of the lamp base. A height of the cavity corresponds to at least a length of the connector pin of the lamp base.

By providing a housing with a specifically adapted cavity, the safety of the lamp socket can be improved. In particular, the height of the cavity corresponds to at least the length of the connector pin of the lamp base that is to be received by the lamp socket. By this, it is possible to protect the user from an electrical shock during plugging the lamp base to and/or un-plugging the lamp base from the lamp socket. Having a height that is at least the length of the connector pin may ensure that the connector pin is never electrically conductively connected to the lamp socket and freely accessible from outside at the same time. In other words, the connector pin may always be surrounded by the housing during plug-in or plug-out.

In a particularly preferred embodiment, the height of the cavity is at least 5 mm, even more preferred at least 6 mm and at most 15 mm.

The housing is made from an electrically insulating material. Preferably, the housing consists of a plastics material and/or a ceramics material. The material of the housing preferably has a high tracking resistance, i.e. a good suppression of leakage currents (also called: creepage currents). Preferably, the comparative tracking index (CIT) of the material of the housing is at least 100, particularly preferably at least 175.

The cavity preferably is a recess in the housing. The cavity is entirely framed, i.e. entirely surrounded, by the housing in lateral directions, in particular by a cavity wall of the cavity. The cavity wall extends away from the bottom of the cavity along the vertical direction. The vertical direction runs perpendicular to the lateral directions. Preferably, the lateral directions span the bottom of the cavity.

The cavity is adapted for receiving a connector casing of the lamp base. The connector casing may be a plug housing of the lamp base. The connector casing may be adapted to fit into the cavity such that a releasable form-fitting connection is provided between the lamp socket and the lamp base during connection of the two.

The receptacle preferably is a female connector for receiving the connector pin of the lamp base. Preferably, the lamp base comprises a plurality of connector pins, particularly preferably exactly two connector pins. For each connector pin, the lamp socket preferably comprises exactly one receptacle. In other words, the number of receptacles may correspond to the number of connector pins.

The receptacle is comprised by the bottom of the cavity, i.e. is positioned at the bottom of the cavity. In a preferred embodiment, the receptacle is a metallic clamp, in particular a copper or brass clamp. For establishing the connection with the connector pin, the receptacle may further comprise and/or be connected to a spring that may push the clamp arms of the receptacle together.

Hereinafter, a height of the housing along a vertical direction may be at most 10 cm, preferably at most 7 cm and even more preferably at most 5 cm. All minimum distances for improving the safety of the lamp socket as described in connection with the following embodiments may be further chosen such that a compact housing is provided.

According to at least one embodiment of the lamp socket, the receptacle is positioned at the bottom of the cavity and projects away from the cavity in a vertical direction. The receptacle is adapted for establishing an electrically conductive connection of the connector pin to an electrical contact of the lamp socket. In the case of the receptacle being a metallic clamp, the upper part of the clamp arms may be connected to the bottom of the cavity, wherein the clamp arms are positioned beneath the bottom in the vertical direction.

According to at least one embodiment of the lamp socket, the housing entirely frames the receptacle and the electrical contact in the lateral directions. The receptacle and the electrical contact may thus be electrically insulated to the outside, in particular a user, by the housing. In particular, a user may be protected from an electrical shock by the housing.

According to at least one embodiment of the lamp socket, the housing projects beyond the receptacle in the vertical direction by at least 5 mm. Preferably, the housing projects beyond the receptacle in the vertical direction by at least 8 mm. Providing a distance of at least 5 mm allows for meeting safety requirements that are defined by various safety standards. By this distance, the electrically conducting part of the receptacle is distanced from the outside, in particular the user, by at least 5 mm, preferably at least 8 mm.

According to at least one embodiment of the lamp socket, the electrical contact has a first part, which is electrically conductively connected to the receptacle, and a second part, which extends away from the receptacle in the vertical direction. The second part is directly enclosed by an electrical insulation and entirely framed by the housing in the lateral directions. A length of the second part is at least 5 mm, preferably at least 8 mm. For example, the electrical contact is a wire or an electrically conducting filament. The first part may be an uninsulated part of the wire or the filament, wherein the second part may be an insulated part of the wire or the filament.

According to at least one embodiment of the lamp socket, a shape of the cavity corresponds to a shape of the connector casing of the lamp base. In particular, the cavity may have a negative shape that corresponds to the positive shape of the connector casing or vice versa. The shape of the cavity and the connector casing may be apposite.

According to at least one embodiment of the lamp socket, the shape of the cavity corresponds to a rectangular cuboid with at least one socket chamfer. The socket chamfer may be a truncated edge of the cuboid. Preferably, the cuboid has two socket chamfers that are positioned at opposite edges of the rectangle. In a top view on the cavity from the vertical direction, the cavity may thus have the shape of rectangle with a truncated corner, in particular two truncated corners that are positioned at opposite corners of the rectangle, preferably with respect to a diagonal of the rectangle.

According to at least one embodiment of the lamp socket, the housing comprises an opening for receiving a mechanical fastener for mechanically fastening the lamp socket to an object, in particular a luminaire. The opening is positioned at the bottom of the cavity and designed such that a distance of the mechanical fastener and the bottom of the cavity is at least 5 mm. Preferably, the distance is at least 10 mm. The mechanical fastener may be a screw and/or a bolt. The opening may have a diameter that corresponds to at least the diameter of a screw head (or bolt head) of the mechanical fastener. A depth of the opening is chosen such that the distance of the bottom of the cavity and the mechanical fastener is at least 5 mm. This may allow for preventing an electrical flashover to the mechanical fastener.

Preferably, the mechanical fastener is a screw, particularly preferably an oval-head screw or a fillister head screw, for example according to DIN norm ISO 7045 or ISO 7049 (preferably the current release at the date of filing). Depending on the mechanical fastener that is to be used, the required diameter of the opening and the required depth of the opening are fixed. The depth may depend on a thickness of the screw head and/or the bolt head.

If a screw is used as a mechanical fastener, the diameter of the head of the screw is preferably at most 6 mm. In this case, the diameter of the opening may be at most 6 mm, in particular 6 mm. In general, the length of the screw is chosen according to the material of the object and/or the shape of the object to which the lamp socket is fastened to. For example, if the lamp socket is mounted to an object with mechanical thread holes, a mechanical thread screw, in particular an M3x8 screw according to ISO7045 M3x8, is preferred. If the lamp socket is mounted to a surface without mechanical thread holes, an ST2.9x13 or ST2.9x19 screw according to ISO 7049 is preferred.

According to at least one embodiment of the lamp socket, the opening has a depth, which extends from the bottom of the cavity to a contact surface for the mechanical fastener. The contact surface may be a seating surface for a head, in particular a screw head and/or a bolt head, of the mechanical fastener. The depth is at least 5 mm, preferably at least 8 mm. The opening has a diameter along its depth, wherein the diameter may correspond to the diameter of the head of the mechanical fastener. At the contact surface, the diameter may be reduced, for example by a ring-shaped insert and/or by a ring-shaped part of the housing. The ring of the ring-shaped insert or part may be the contact surface. The inner part of the ring-shaped insert may have a further diameter that is smaller than the diameter of the opening. The further diameter may, for example, correspond to a diameter of a fastening part of the mechanical fastener, in particular a thread of the mechanical fastener.

According to at least one embodiment of the lamp socket, the bottom of the cavity is formed by an electrically insulating plate. The receptacle is mounted to the plate. The plate is connected to the housing by a mechanical connection element that at least partly projects away from the cavity in the vertical direction. The mechanical connection element is entirely framed by the housing in the lateral directions. The housing projects beyond the mechanical connection element in the vertical direction by at least 5 mm, preferably at least 6 mm.

For example, the mechanical connection element is a rivet, wherein a head of the rivet is positioned at a side of the plate facing the cavity and the shaft of the rivet extends through the plate beyond the bottom of the cavity. A part of the rivet may then face away from the cavity. Preferably, the mechanical connection element projects into a further opening of the housing that is adapted for receiving the mechanical connection element. For holding the receptacle, the electrically insulating plate may comprise a recess into which the receptacle may be mounted.

According to at least one embodiment of the lamp socket, all electrically conductive components of the lamp socket, except for the second part of the electrical contact, are entirely framed by the housing in the lateral directions and the housing projects beyond all electrically conductive components of the lamp socket, except for the second part of the electrical contact, in the vertical direction by at least 5 mm.

Further, a lamp base, in particular a pin-based lamp base, is provided. Preferably, the lamp base is adapted for being received by a lamp socket as described herein. That is to say, all features that are disclosed with reference to the lamp socket are also disclosed for the lamp base and vice versa.

The lamp base comprises a connector casing and a connector pin. The lamp base is adapted for being received by a lamp socket, in particular the lamp socket as described above.

According to at least one embodiment of the lamp base, an extension of the connector casing along the main extension direction of the connector pin corresponds to at least a length of the connector pin. That is to say, the connector casing is at least as thick as the connector pins. Thereby, it is possible to provide a lamp socket with a cavity for receiving the connector casing, wherein the cavity has a height that corresponds to at least the length of the connector pin.

According to at least one embodiment of the lamp base, the shape of the connector casing corresponds to a rectangular cuboid with at least one base chamfer. Preferably, the connector casing has two base chamfers that are positioned at opposite edges of the connector casing. In a top view on the connector casing, the connector casing may have the shape of a rectangle with a truncated corner.

Particularly preferably, the cavity and the connector casing have the same shape and the same dimensions. For example, in the case of a rectangular cuboid, the length, height and width of the rectangular cuboid of the cavity and the rectangular cuboid of the connector casing may be identical. Further, the socket chamfer of the cavity and the base chamfer are preferably positioned at the same edge or at the same edges of the cuboid.

By having an identically shaped cavity and connector casing, accidentally inserting a lamp base that is not adapted for the lamp socket may be prevented. For example, a lamp base for a lighting device with an operating voltage that is less than the operating voltage provided by the lamp socket, as for example a lamp base for a lighting device with an operating voltage of 12 V, cannot be inserted into the lamp socket.

Furthermore, a lighting device is provided. The lighting device preferably comprises a lamp base described herein. That is to say, all features that are disclosed with reference to the lamp base and the lamp socket for the lamp base are also disclosed for the lighting device and vice versa.

The lighting device comprises a lamp base, preferably the lamp base as described above. The lighting device has an operating voltage of at least 50 V, preferably at least 100 V and particularly preferably at least 150 V. The lighting device may, for example, be a halogen lamp and/or an LED retrofit lamp. Preferably, the lighting device comprises at least one lighting means, such as a light-emitting diode and/or a filament.

Furthermore, a lighting system is provided. The lighting device preferably comprises a lamp socket and a lighting device as described herein. That is to say, all features that are disclosed with reference to the lamp base, the lighting device, and the lamp socket are also disclosed for the lighting system and vice versa.

The lighting system comprises a lamp socket, preferably a lamp socket as described above, and a lighting device, preferably a lighting device as described above. The lighting device is preferably adapted for being received by the lamp socket.

BRIEF DESCRIPTION OF THE DRAWINGS

Preferred embodiments of the invention will be explained in the following, having regard to the drawings. It is shown in.

DETAILED DESCRIPTION OF THE INVENTION

Figure 1A:
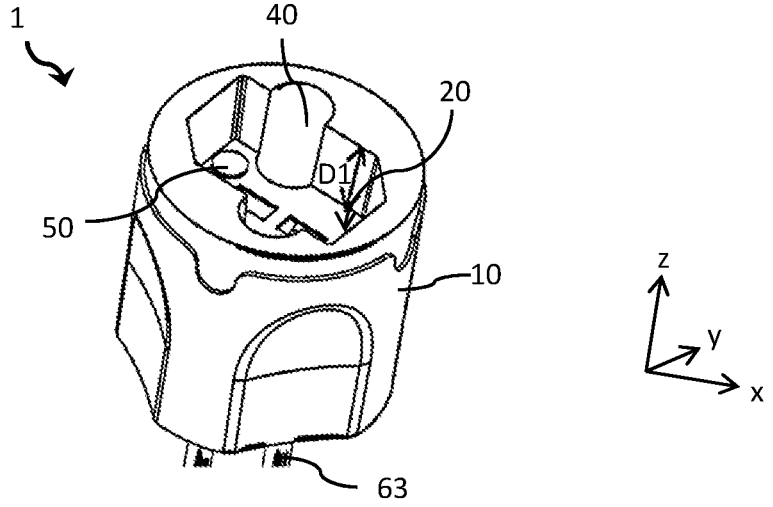
FIGS. 1A, 1B, 1C, 2 and 3A show exemplary embodiments of a lamp socket according to the present invention.

In the following, preferred embodiments of the invention will be described with reference to the drawings. Here, elements that are identical, similar or have an identical or similar effect are provided with the same reference numerals in the figures. Repeating the description of such elements may be omitted in order to prevent redundant descriptions.

The figures and the size relationships of the elements illustrated in the figures among one another should not be regarded as to scale. Rather, individual elements may be illustrated with an exaggerated size to enable better illustration and/or better understanding.

Figure 1B:
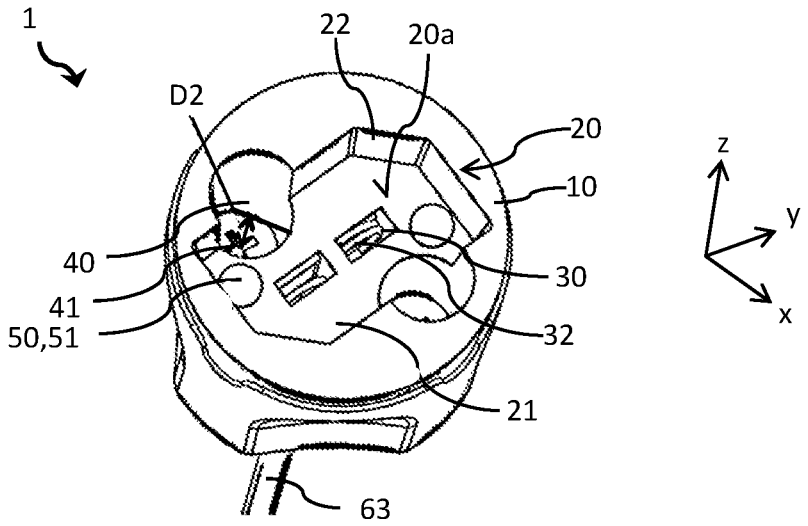
Figure 1C:
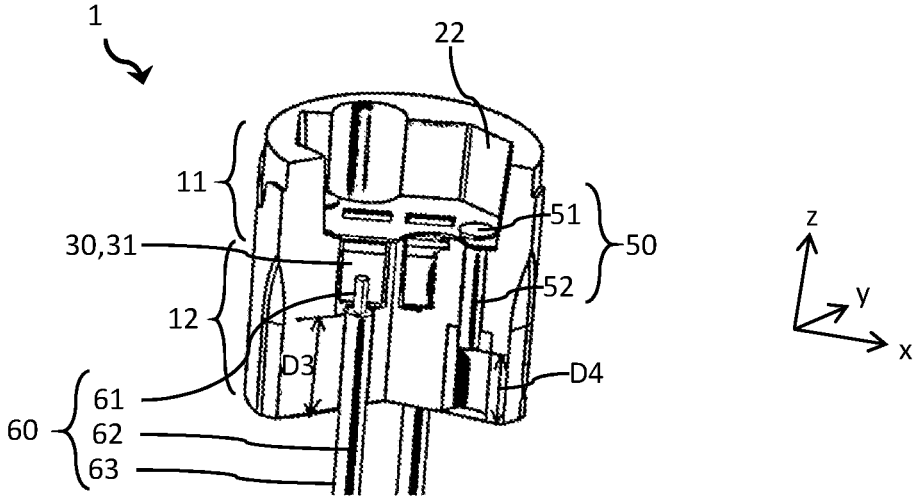

With reference to the schematic drawings of FIGS. 1A, 1B and 1C, an exemplary embodiment of a lamp socket 1 according to the present invention is explained in detail. FIG. 1A shows a schematic side view of the lamp socket 1, FIG. 1B shows a schematic top view of the lamp socket 1, and FIG. 1C shows a schematic sectional view of the lamp socket 1.

The lamp socket 1 comprises a housing 10 with a cavity housing part 11 and a connector part 12 (FIG. 1C) that are arranged on top of each other in a vertical direction z. The cavity housing part 11 and the connector part 12 directly adjoin each other and/or are formed integrally. The cavity 20 is entirely surrounded by the housing 10, in particular the cavity housing part 11, in the lateral directions x, y. The connector part 12 surrounds electrical connection means of the lamp socket 1 and/or electrically conductive components of the lamp socket 1. In particular, the connector part 12 comprises an electrical contact 60.

The cavity has a height D1 that is at least a length of a connector pin 102 of a lamp base 100 that is adapted to be placed into the lamp socket 1. Preferably, the height D1 is at least 5 mm, particular preferably 6.7 mm The cavity 20 has a rectangular shape with a truncated corner, that forms a socket chamfer 22.

A bottom 20*a* of the cavity 20 is formed by an electrically insulating plate 21 that is connected to the housing 10 by a mechanical connecting element 50, in particular a rivet. The mechanical connecting element 50 may be formed with a metal such as aluminum. A head 51 of the mechanical connecting element 50 is positioned in the cavity 20 and the shaft 52 of the mechanical connecting element 50 projects through the plate 21 and away from the cavity 20 in the vertical direction z. A distance D4 of the mechanical connecting element 50 and an outer area of the housing 10 in the vertical direction z is at least 5 mm, in particular 6.4 mm. That is to say, the housing 10 extends beyond the mechanical connecting element 50 in the vertical direction z by at least 5 mm.

The housing 10 comprises an opening 40 for receiving a mechanical fastener 41. The depth of the opening 40 is such that a distance D2 between the mechanical fastener 41 and the bottom 20*a* of the cavity 20 is at least 5 mm, in particular 10.9 mm.

At the bottom 20*a* of the cavity 20, a receptacle 30 is positioned. The receptacle 30 may be formed with a clamp 31 and a spring 32. The clamp 31 is positioned at a hole of the electrically insulating plate 21, thereby providing a feedthrough for inserting the connector pin 102 into the clamp 31. The receptacle 30 is adapted for receiving the connector pin 102 and electrically conductively connecting said connector pin 102 to electrical contacts 6 of the lamp socket 1.

Each electrical contact 60 comprises a first part 61 and a second part 62. The first part 61 provides the electrically conductive connection to the receptacle 30 the second part 62 is insulated by an electrical insulation 63. The second part 62 projects beyond the housing 10 in the vertical direction 10. The first part 61 of the electrical contact 60 and/or the clamp 31 of the receptor 30 are distanced to an outer area of the housing 10 by a distance D3 of at least 5 mm, in particular 8.6 mm.

Figure 2:
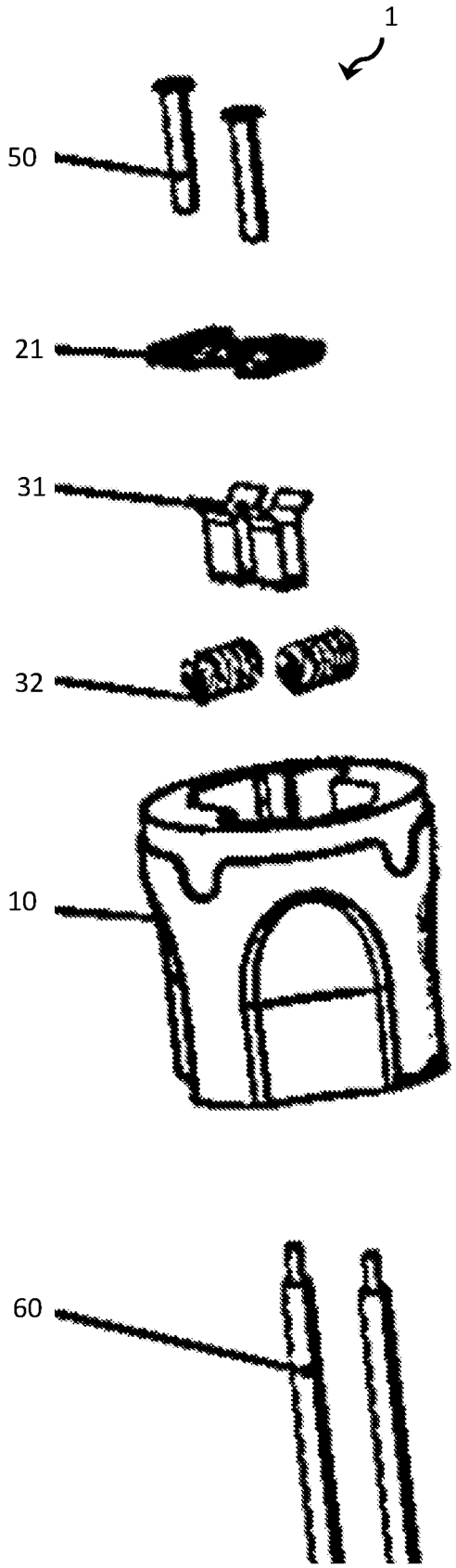

With reference to the schematic blow-up scheme of FIG. 2, an embodiment of the lamp socket 1 according to the present invention is explained in detail. FIG. 2 shows the lamp socket 1 of FIGS. 1A to 1C in a blow-up scheme. The lamp socket 1 comprises the housing 10, the electrically insulating plate 21, the clamps 31 and the springs 32 for the receptacle 30, the mechanical connection elements 50 for connecting the plate 21 to the housing 10, and the electrical contacts 31.

Figure 3A:
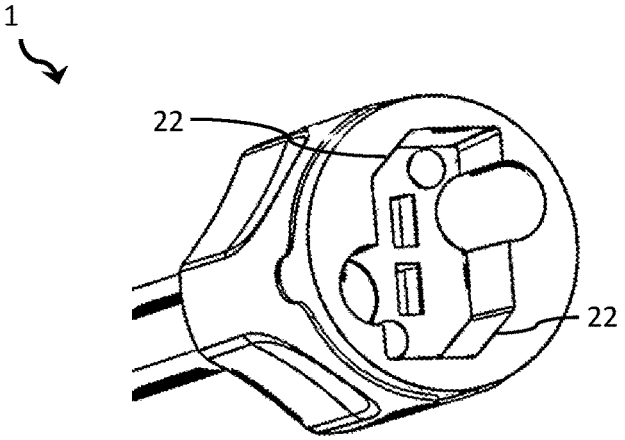
Figure 3B:
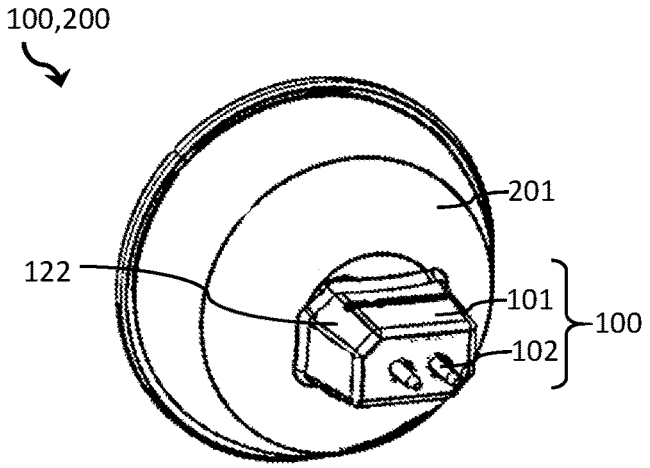
FIG. 3B shows an exemplary embodiment of a lamp base and a lighting device according to the present invention.

With reference to the schematic drawings of FIGS. 3A and 3B, an exemplary embodiment of a lamp socket 1 and an exemplary embodiment of a lamp base 100 and a lighting device 200 according to the present invention is explained in detail.

FIG. 3A shows an embodiment of a lamp socket 1, in particular the lamp socket 1 according to FIGS. 1A to 1C and 2. The lamp socket 1 has the cavity 20. The cavity 20 has the shape of a rectangular cuboid and comprises two socket chamfers 22 at opposite edges of the cavity 20.

FIG. 3B shows an embodiment of a lamb base 100 that is part of a lighting device 200. The lamp base 100 is a pin-based lamp base 100 and has a connector casing 101 and the connector pins 102. The lamp base 100 is connected to a lighting body 201 of a lighting device 200. The lighting body 201 may comprise a lighting means, such as a light-emitting diode. In addition, the lighting body 201 may comprise a reflector for shaping the light emitted by the lighting means.

The connector casing 101 of the lamp base 100 has the negative shape of the cavity 20 of the lamp socket 1 according to FIG. 3A. In particular, the connector casing 101 has the shape of a rectangular cuboid and comprises two base chamfers 122 at opposite edges of the connector casing 101. The socket chamfers 122 of the lamp base 100 are positioned such that the lamp base 100 may be inserted into the lamp socket 1 according to FIG. 3A.

Due to the socket chamfers 22 and the base chamfers 122, only the lamp base 100 and the lighting device 200 that are adapted for being received by the lamp socket 1 may be placed into the lamp socket 1. Thereby, a connection of an alternative lighting device, which has an operating voltage that differs from the voltage provided by the lamp socket 1, may be prevented and the safety is improved.

Figure 4:
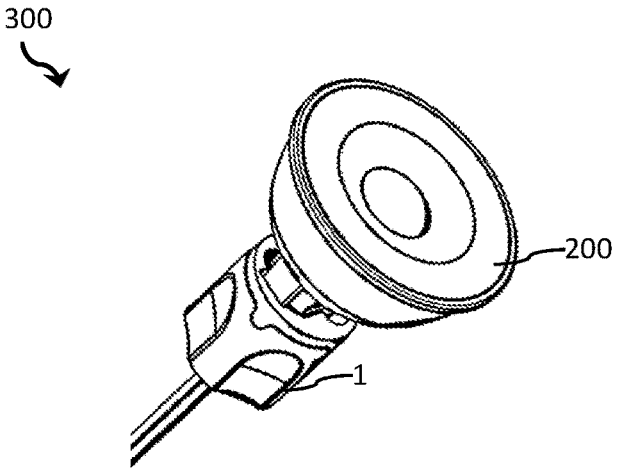
FIG. 4 shows an exemplary embodiment of a lighting system according to the present invention.

According to the schematic drawing of FIG. 4, an exemplary embodiment of a lighting system 300 according to the present invention is explained in detail. The lighting system 300 comprises a lighting device 200 and a lamp socket 1. The lighting device 200 and the lamp socket 1 are connected, in particular via the cavity 20 of the lamp socket 1.

The lamp socket 1 described herein preferably is formed with commonly known components, which may also be used in currently known lamp sockets for a 12 V lighting device. Thereby, the production costs of the lamp socket 1 can be improved.

The invention is not restricted by the description based on the embodiments. Rather, the invention comprises any new feature and also any combination of features, including in particular any combination of features in the patent claims, even if this feature or this combination itself is not explicitly specified in the patent claims or exemplary embodiments.

LIST OF REFERENCE NUMERALS

1 lamp socket
10 housing
11 cavity housing part
12 connector part
20 cavity
21 electrically insulating plate
22 socket chamfer
20*a* bottom
22 socket chamfer
30 receptacle
31 clamp
32 spring
40 opening
41 mechanical fastener
50 mechanical connection element
51 head of the mechanical connection element
52 shaft of the mechanical connection element
60 electrical contact
61 first part of the electrical contact
62 second part of the electrical contact
63 electrical insulation
100 lamp base
101 connector casing
102 connector pin
122 base chamfer
200 lighting device
201 lighting body
300 lighting system
x,y lateral directions
z vertical direction
D1 height of the cavity
D2 distance between the mechanical fastener and the bottom of the cavity
D3 distance of the outer area of the housing to the first part of the electrical contact and/or the clamp
D4 distance of the outer area of the housing to the mechanical connection element

The invention claimed is:

1. A lamp socket for a pin-based lamp base, the lamp socket comprising:
- an electrically insulating housing having a cavity that is entirely framed by the housing in lateral directions, wherein:
  - the cavity is adapted for receiving a connector casing of the pin-based lamp base;
  - a bottom of the cavity comprises a receptacle adapted for receiving a connector pin of the pin-based lamp base outside of the cavity;
  - an electrically conductive clamp is at least partially disposed within an interior space of the receptacle and is configured to make an electrical connection with the connector pin within the interior space of the receptacle;
  - a spring is at least partially disposed within the interior space of the receptacle and is configured to bias the clamp into contact with the connector pin within the interior space of the receptacle; and
  - a height of the cavity corresponds to at least a length of the connector pin.

2. The lamp socket according to claim 1, wherein the receptacle is positioned at the bottom of the cavity and projects away from the cavity in a vertical direction, wherein the receptacle is adapted for establishing an electrically conductive connection of the connector pin to an electrical contact of the lamp socket.

3. The lamp socket according to claim 2, wherein the housing entirely frames the receptacle and the electrical contact in the lateral directions.

4. The lamp socket according to claim 3, wherein the housing projects beyond the receptacle in the vertical direction by at least 5 mm.

5. The lamp socket according to claim 3, wherein the electrical contact has:

a first part, which is electrically conductively connected to the receptacle; and a second part, which extends away from the receptacle in the vertical direction, wherein the second part is directly enclosed by an electrical insulation and entirely framed by the housing in the lateral directions, wherein a length of the second part is at least 5 mm.

6. The lamp socket according to claim 1, wherein a shape of the cavity corresponds to a shape of the connector casing of the pin-based lamp base.

7. The lamp socket according to claim 1, wherein a shape of the cavity corresponds to a rectangular cuboid with at least one socket chamfer.

8. The lamp socket according to claim 1, wherein the housing comprises an opening for receiving a mechanical fastener adapted for mechanically fastening the lamp socket to an object, wherein the opening is positioned at the bottom of the cavity and designed such that a distance between the mechanical fastener and the bottom of the cavity is at least 5 mm.

9. The lamp socket according to claim 8, wherein the opening has a depth that extends from the bottom of the cavity to a contact surface for the mechanical fastener, wherein the depth is at least 5 mm.

10. The lamp socket according to claim 1, wherein the bottom of the cavity is formed by an electrically insulating plate, wherein the receptacle is mounted to the plate and the plate is connected to the housing by a mechanical connection element that at least partly projects away from the cavity in the vertical direction, wherein the mechanical connection element is entirely framed by the housing in the lateral directions, and wherein the housing projects beyond the mechanical connection element in the vertical direction by at least 5 mm.

11. A pin-based lamp base comprising:

a connector casing; and a connector pin;

wherein the pin-based lamp base is adapted for being received by a lamp socket according to claim 1.

12. The pin-based lamp base according to claim 11, wherein an extension of the connector casing along a main extension direction of the connector pin corresponds to at least a length of the connector pin.

13. The pin-based lamp base according to claim 11, wherein a shape of the connector casing corresponds to a rectangular cuboid with at least one base chamfer.

14. A lighting device comprising the pin-based lamp base according to claim 11, wherein an operating voltage of the lighting device is at least 50 V.

15. The lamp socket according to claim 1, wherein the bottom of the cavity is formed by an electrically insulating plate which has a recess formed therein, wherein the receptacle is mounted in the recess outside of the cavity.

16. The lamp socket according to claim 1, wherein:

the bottom of the cavity is formed by an electrically insulating plate having a hole formed therein; and the clamp is positioned at the hole so as to provide a feedthrough for inserting the connector pin of the pin-based lamp base into the clamp.

17. The lamp socket according to claim 1, wherein a shape of the cavity is a negative of a shape of the connector casing.

18. The lamp socket according to claim 1, wherein the receptacle does not extend into the cavity.

19. The lamp socket according to claim 1, wherein the cavity and the receptacle co-terminate at a plane that extends substantially perpendicular to the height of the cavity.

* * * * *